US010945500B2

(12) United States Patent
Leuz

(10) Patent No.: US 10,945,500 B2
(45) Date of Patent: Mar. 16, 2021

(54) ITEM OF JEWELRY

(71) Applicant: GEBRÜDER SCHAFFRATH GMBH, Hanau (DE)

(72) Inventor: Alexander Leuz, Hanau (DE)

(73) Assignee: GEBRÜDER SCHAFFRATH GMBH, Hanau (DE)

( * ) Notice: Subject to any disclaimer, the term of this patent is extended or adjusted under 35 U.S.C. 154(b) by 0 days.

(21) Appl. No.: 15/568,082

(22) PCT Filed: Apr. 22, 2016

(86) PCT No.: PCT/DE2016/000182
§ 371 (c)(1),
(2) Date: Oct. 20, 2017

(87) PCT Pub. No.: WO2016/169549
PCT Pub. Date: Oct. 27, 2016

(65) Prior Publication Data

US 2018/0116348 A1 May 3, 2018

(30) Foreign Application Priority Data

Apr. 24, 2015 (DE) ..... 10 2015 005 477

(51) Int. Cl.
*A44C 17/02* (2006.01)
*A44C 7/00* (2006.01)
*A44C 9/00* (2006.01)

(52) U.S. Cl.
CPC ..... *A44C 17/0275* (2013.01); *A44C 7/003* (2013.01); *A44C 9/00* (2013.01); *A44C 17/0258* (2013.01)

(58) Field of Classification Search
CPC ..... A44C 17/0258; A44C 17/0266; A44C 25/001; A44C 25/007; A44C 17/0275; A44C 17/02; A44C 17/0241; A44C 17/025; A44C 17/0283; A44C 17/0291
USPC ..... 63/13, 14.1, 20, 33, 31
See application file for complete search history.

(56) References Cited

U.S. PATENT DOCUMENTS

| | | | | | |
|---|---|---|---|---|---|
| 4,294,084 | A * | 10/1981 | Lampert | ..... | A44C 17/025 63/15 |
| 7,162,891 | B2 * | 1/2007 | Leuz | ..... | A44C 17/02 63/26 |
| 2003/0172673 | A1 * | 9/2003 | Kimura | ..... | A44C 17/0275 63/29.1 |

FOREIGN PATENT DOCUMENTS

| | | | | |
|---|---|---|---|---|
| EP | 1190637 | A2 | 3/2002 | |
| EP | 1336351 | B1 | 8/2003 | |
| JP | 3390168 | B1 * | 3/2003 | ..... A44C 17/0275 |
| JP | 2009171993 | A | 8/2009 | |
| WO | 02065868 | A1 | 8/2002 | |
| WO | 2014082622 | A1 | 6/2014 | |

* cited by examiner

*Primary Examiner* — Jack W Lavinder
(74) *Attorney, Agent, or Firm* — Lucas & Mercanti, LLP; Klaus P. Stoffel

(57) ABSTRACT

An item of jewelry having a base element and at least one gem which is mounted so that it can be moved in the base element such that the gem can move with respect to the base element. The gem is arranged, at least in areas, in a recess of the base element and is secured by at least one retaining element to prevent falling out from the recess. The retaining element extends from the base element slightly over one part of the upper side of the gem such that the center of the upper side is not covered b the retaining element.

4 Claims, 9 Drawing Sheets

ITEM OF JEWELRY

The present application is a 371 of International application PCT/DE2016/000182, filed Apr. 22, 2016, which claims priority of DE 10 2015 005 477.5, filed Apr. 24, 2015, the priority of these applications is hereby claimed and these applications are incorporated herein by reference.

BACKGROUND OF THE INVENTION

The invention relates to an item of jewelry which has a base element and at least one decorative element mounted in the base element in a movable manner such that the decorative element is mounted so as to be movable relative to the base element, and in which the decorative element is arranged at least regionally in a recess in the base element and is secured against dropping out of the recess by at least one retaining element.

Items of jewelry of this kind having in particular movably mounted diamonds are already known in various embodiments. For example, items of jewelry of this kind are described in WO 2014/082622 A1. In said document, the movable diamond is secured against dropping out by a stirrup-like retaining element extending over the diamond. Further prior art is formed by EP 13 36 351 B1.

Likewise, it is already known to arrange a movable diamond beneath a transparent disk of an item of jewelry.

The already known items of jewelry having movable decorative elements have the drawback that the retaining element covers precisely that region in the region of a top side of the decorative element that has particularly high light-reflecting properties. In the case of a diamond, what is known as a facet cut is frequently arranged in the region of the top side, this causing diverse light reflections. In the event of a movement of the decorative element relative to the base element that is caused by movements of the wearer, the spatial orientations of the reflective surfaces change permanently, and so an extremely vibrant reflective behavior can be generated.

SUMMARY OF THE INVENTION

It is the object of the present invention to design an item of jewelry of the type mentioned at the beginning such that visibly perceptible reflection effects are even more perceptible.

This object is achieved according to the invention in that the retaining element extends, starting from the base element, over only a part of a top side of the decorative element such that a middle of the top side is not covered by the retaining element.

As a result of the design according to the invention, the central region of the top side of the decorative element is freely visibly apparent. In particular, light can strike this region without being impeded by the retaining element and, depending on a particular spatial position of the reflective surfaces, the light can be reflected freely in all directions defined by the reflective surfaces. The brilliant effect when the item of jewelry is worn is improved is improved significantly even further compared with the prior art and an increased attention factor can be achieved.

A typical embodiment is provided in that the decorative element is in the form of a gemstone.

In particular, the idea is for the item of jewelry to be in the form of a diamond.

More diverse reflective effects can be achieved in that a top side of the decorative element has cut facets.

Advantageous movement guidance is achieved in that the recess has a conical center.

In a further variant embodiment, the retaining element is at a distance from a bottom of the recess so as to allow a lifting movement of the decorative element.

Additional reflective effects can be achieved in that the retaining element is at a distance from a bottom of the recess so as to allow a tilting movement of the decorative element.

Furthermore, the idea is also for the retaining element to be at a distance from a bottom of the recess so as to allow a rotational movement of the decorative element.

In one configuration of the item of jewelry as a ring, it has proven to be advantageous for a longitudinal axis of the decorative element to extend substantially in a vertical direction.

In one configuration of the item of jewelry as an ear stud, pendant or necklace, it has proven to be advantageous for a longitudinal axis of the decorative element to extend substantially in a horizontal direction.

The abovementioned embodiments as an earring or ear stud represent variations of a configuration in which the item of jewelry is in the form of an item of ear jewelry.

Optimum visual perceptibility of the decorative element in combination with a further increase in the reflective possibilities is provided in that the decorative element is arranged in the base element so as to be visibly apparent at least regionally at the sides.

BRIEF DESCRIPTION OF THE DRAWING

Preferred embodiments of the invention are explained in more detail in the following text with reference to schematic illustrations, in which.

DETAILED DESCRIPTION OF THE INVENTION

Figure 1:
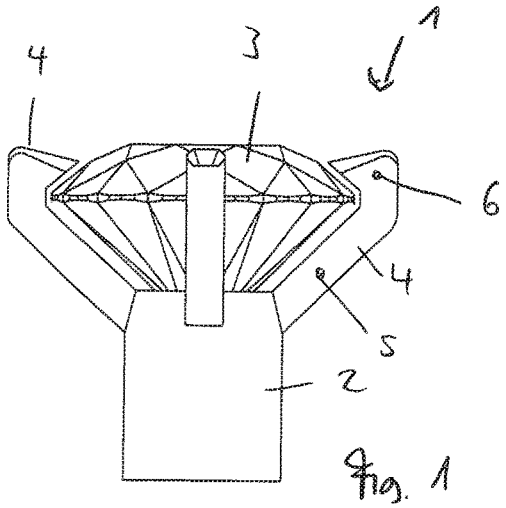
FIG. 1 shows a side view of an item of jewelry having four retaining elements.

FIG. 1 shows an item of jewelry (1) which has a base element (2) and a movable decorative element (3) guided in the base element (2). According to the embodiment in FIG. 1, the decorative element (3) is secured against dropping out of the base element (2) by four retaining elements (4). Three of the four retaining elements (4) are visible in FIG. 1. The retaining elements (4) according to FIG. 1 are hook-shaped. Starting from the base element (2), there extend first of all spacer bars (5) which then transition into stop bars (6). The stop bars (6) each have a longitudinal axis that is oriented in a radial direction relative to a longitudinal axis of the base element (2) so as to project over the decorative element (3) in peripheral regions of the decorative element (3). A center (7) of the decorative element (3) is freely visibly apparent as a result.

In the exemplary embodiment illustrated, the decorative element (3) is in the form of a diamond which has a multiplicity of facets (9) in the region of a top side (8).

Figure 2:
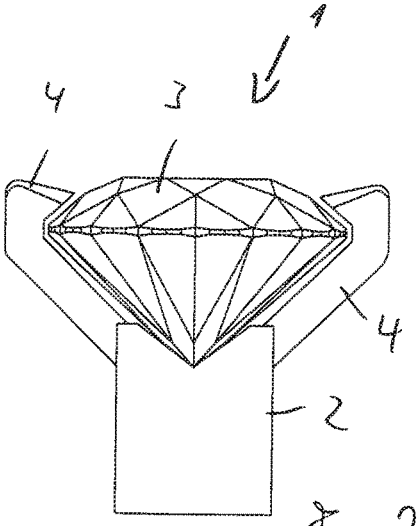
FIG. 2 shows a side view of an item of jewelry having two retaining elements.

According to the modified embodiment in FIG. 2, two retaining elements (4) are used.

Figure 3:
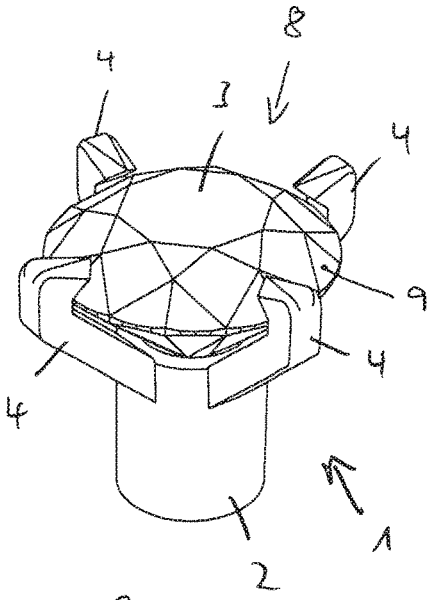
FIG. 3 shows a perspective illustration of the item of jewelry according to FIG. 1.
Figure 4:
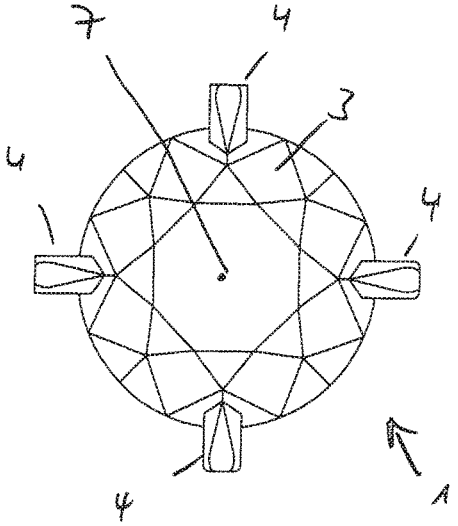
FIG. 4 shows a plan view of the item of jewelry according to FIG. 1.

FIG. 3 shows a perspective plan view of the item of jewelry (1) according to FIG. 1. In this case, the substantially symmetrical arrangement of the retaining elements (4) can be seen. This symmetrical arrangement is clarified and demonstrated once again by the plan view in FIG. 4.

Figure 5:
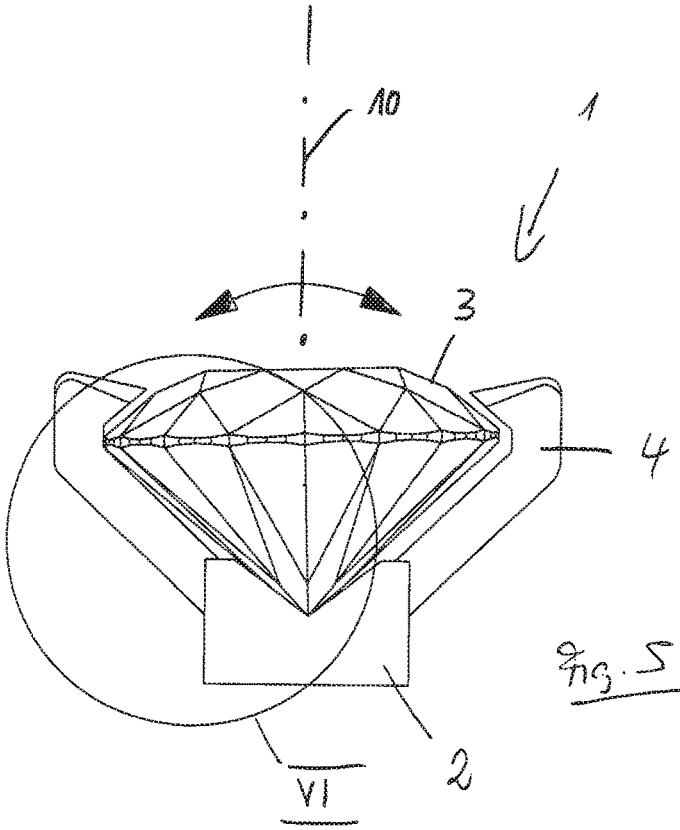
FIG. 5 shows a further illustration demonstrating possible tilting movements of the decorative element in the base element.

FIG. 5 illustrates that the decorative element (4) can carry out tilting movements indicated for example by the black arrows. In order to allow corresponding tilting movements, the decorative element (3) has spacings from the retaining elements (4). As a result, both movements oriented relative to a longitudinal axis (19) with at least one transverse component and movements in the direction of the longitudinal axis (10) are possible.

Figure 6:
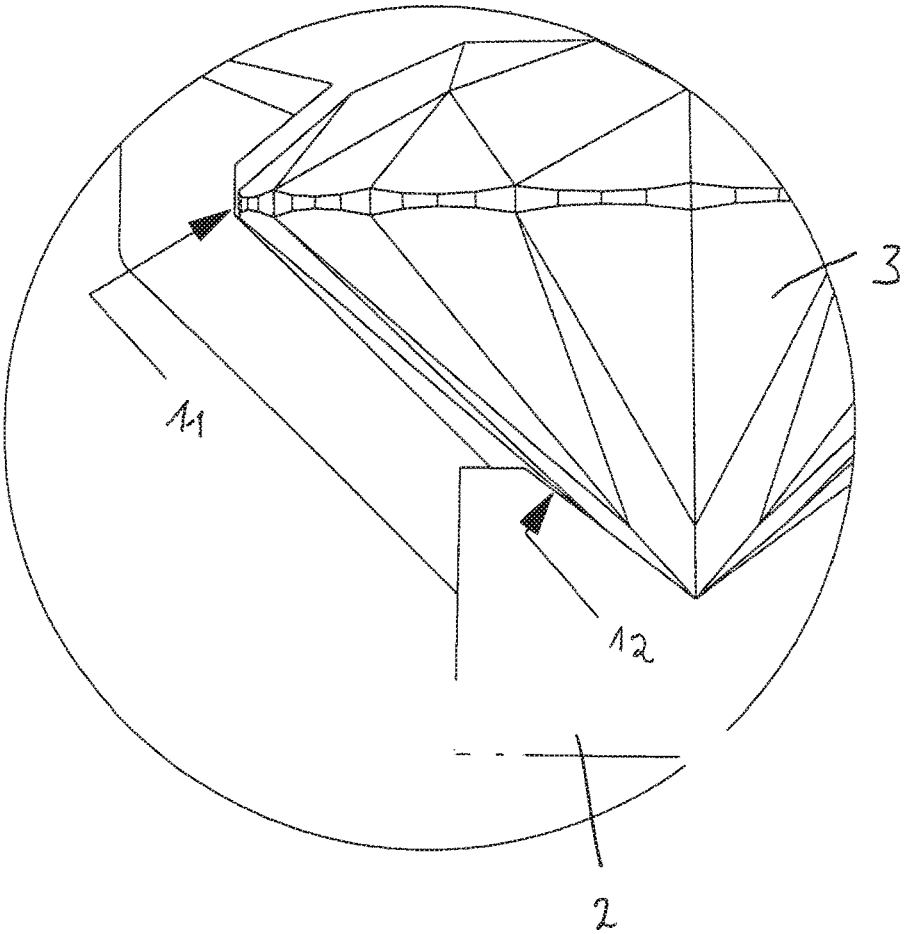
FIG. 6 shows an enlarged illustration of the detail VI in FIG. 5.

The spacings realized are demonstrated once again in the enlarged illustration according to FIG. 6. It can be seen in particular that the retaining element (4) for the decorative element (3) provides a first boundary point (11) and a second boundary point (12). The terms "points" should not be understood mathematically here, but technically, meaning that in fact boundary surfaces with relatively small dimensions are provided.

Figure 8:
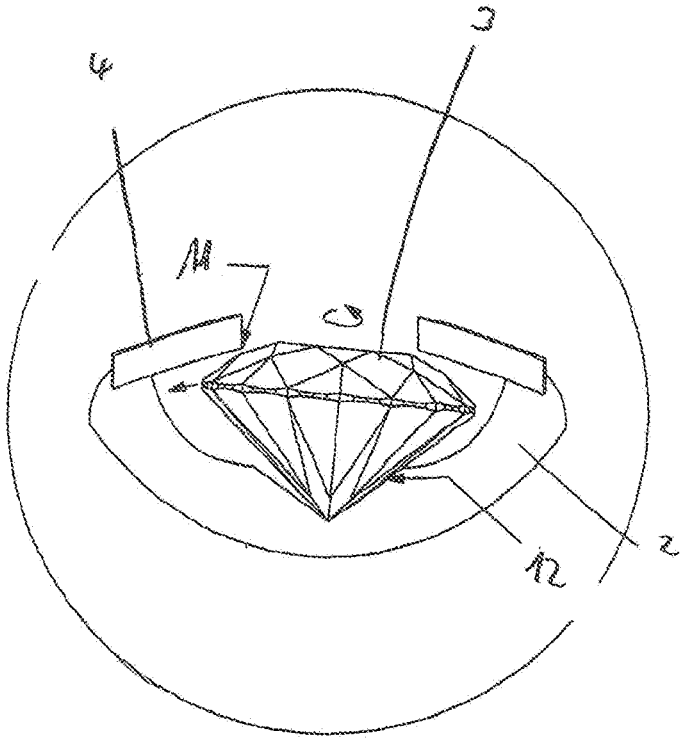
FIG. 8 shows an enlarged illustration of the detail VIII in FIG. 7.
Figure 7:
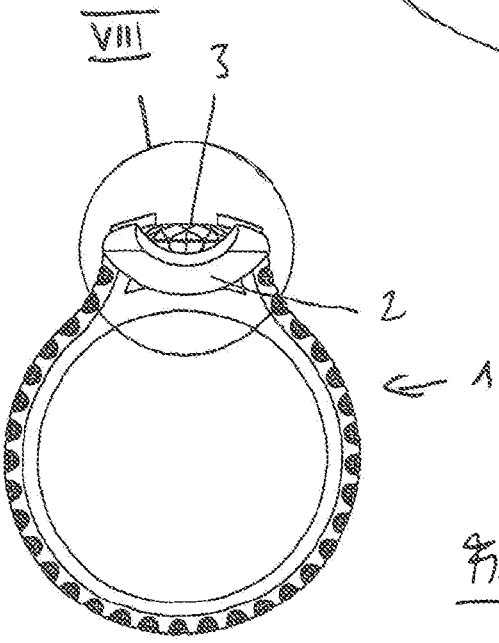
FIG. 7 shows a side view of a ring having a movable decorative element.

FIG. 7 shows a configuration of the item of jewelry (1) as a ring. The base element (2) in this case has a cup-like basic contour for regionally receiving the decorative element (3). The enlarged illustration in FIG. 8 reveals in particular the first boundary point (11) provided in this embodiment by the retaining element (4) and the second boundary point (12) provided by the base element (2). Furthermore, the movement possibilities both in a lateral tilting direction and in a rotational direction are indicated by the black arrows.

FIG. 9 once again illustrates a side view of the combination of the base element (2), with the decorative element (3), and retaining elements (4).

Figure 9:
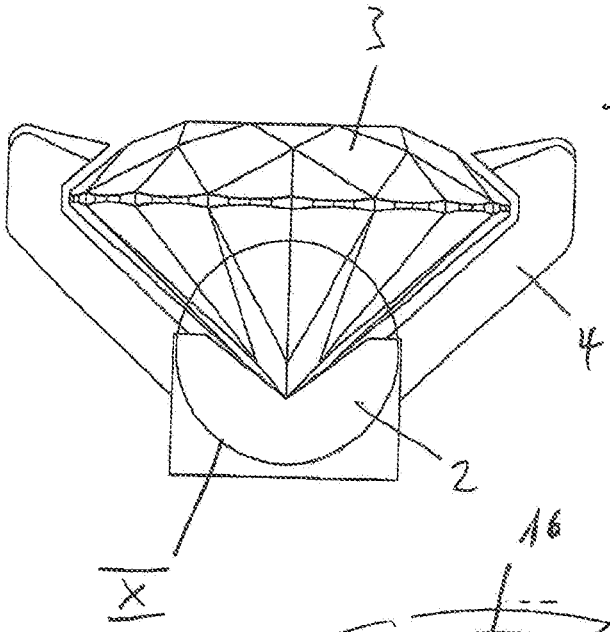
FIG. 9 shows a side view of a further embodiment.
Figure 10:
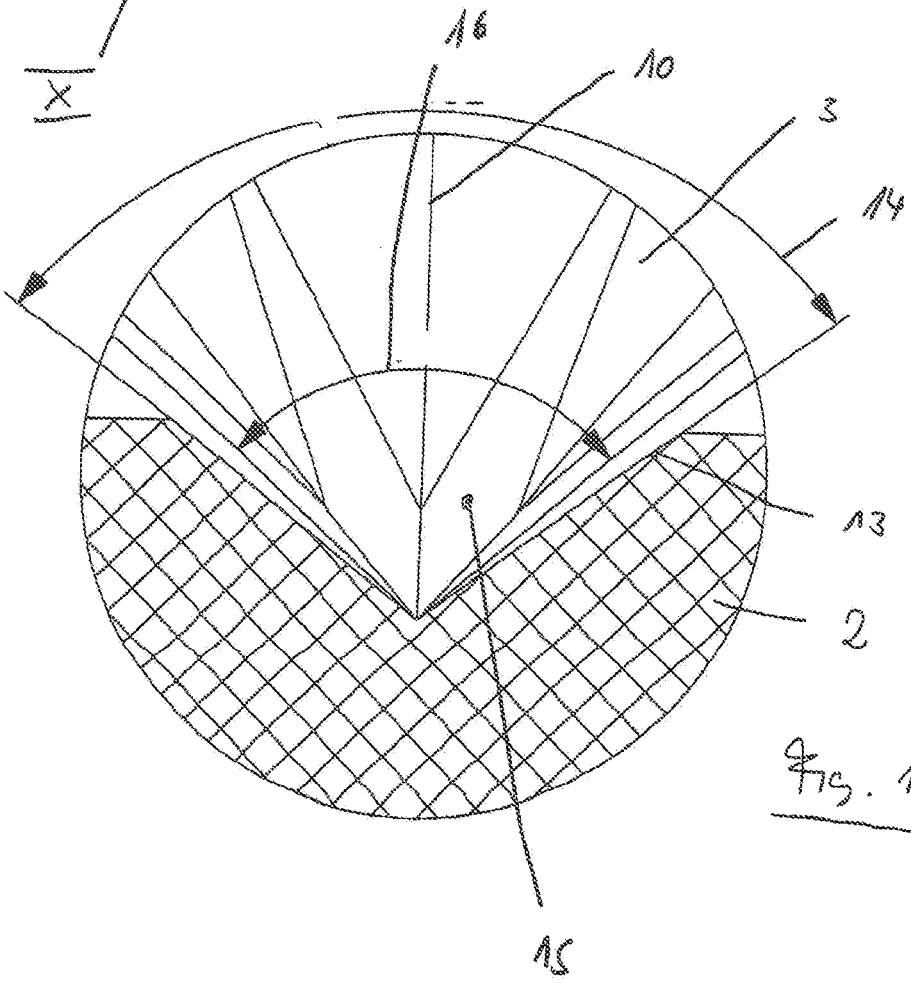
FIG. 10 shows an enlarged illustration of the detail X in FIG. 9, demonstrating ranges of movement.

The enlarged illustration, illustrated in FIG. 10, of the detail (X) in FIG. 9 demonstrates, in a cross-sectional illustration, the structural realization of a conical recess in the base element (2). The conical recess has an opening angle (14). The opening angle is typically at least 99 degrees and typically at most 160 degrees. Opening angles (14) in a range from 104 degrees to 115 degrees have proven to be extremely advantageous. According to FIG. 10, the specifically realized opening angle is 106.32 degrees.

A bottom region (15) of the decorative element (3) extends likewise with a conical basic contour. In this case, a typical opening angle (16) in the exemplary embodiment illustrated is 98 degrees.

FIG. 11 once again shows the item of jewelry (1) with the base element (2), and the decorative element (3).

Figure 12:
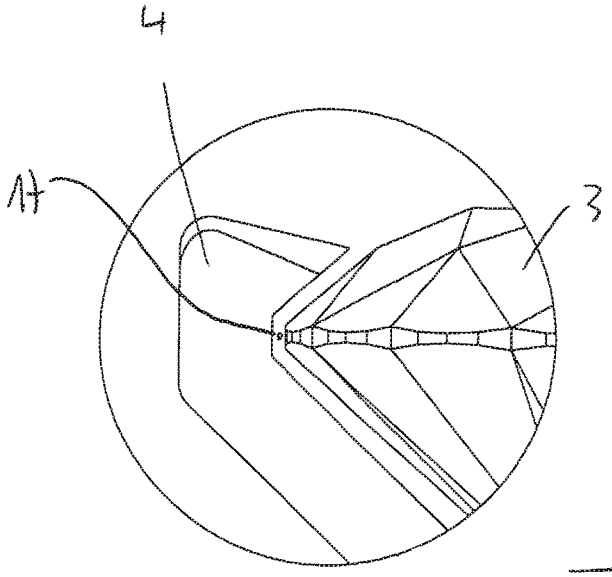
FIG. 12 shows an enlarged illustration of the detail XII in FIG. 11.
Figure 11:
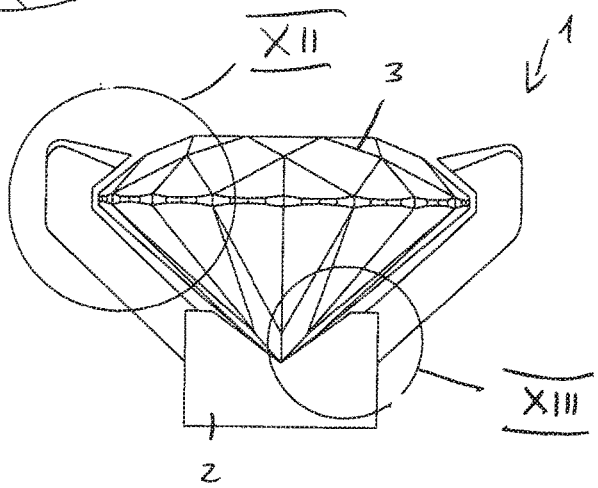
FIG. 11 shows a side view of a further embodiment.

FIG. 12 shows the enlarged detail (XII) in FIG. 11 in order to demonstrate a spacing (17) between the retaining element (4) and the decorative element (3). The spacing (17) is preferably at least 0.05 mm. Likewise, the spacing (17) is preferably at most 0.7 mm. A spacing (17) in a range from 0.1 mm to 0.2 mm has proven to be advantageous.

FIG. 13 once again illustrates, in an enlarged illustration, the guidance of the decorative element (3) in the base element (2).

Figure 14:
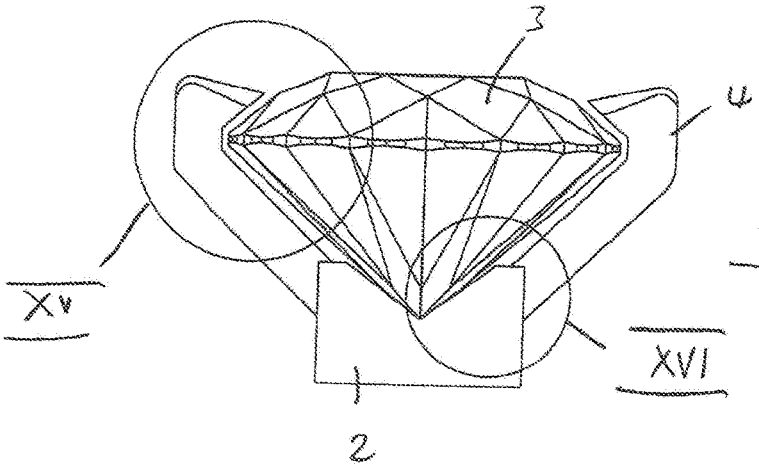
FIG. 14 shows a side view of a further embodiment.

In a further illustration, FIG. 14 shows the mounting of the decorative element (3) in the base element (2) using retaining elements (4).

Figure 13:
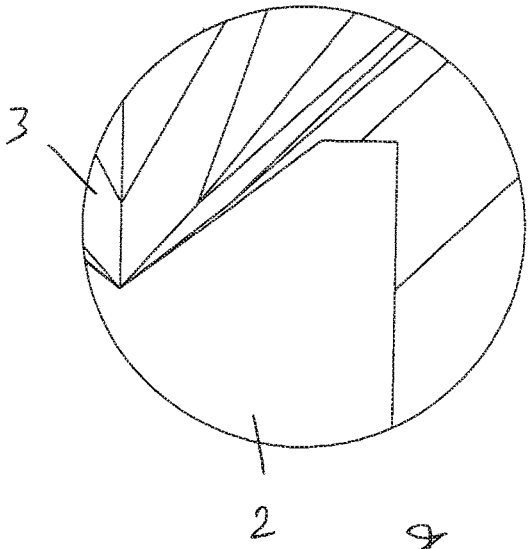
FIG. 13 shows an enlarged illustration of the detail XIII in FIG. 11.
Figure 16:
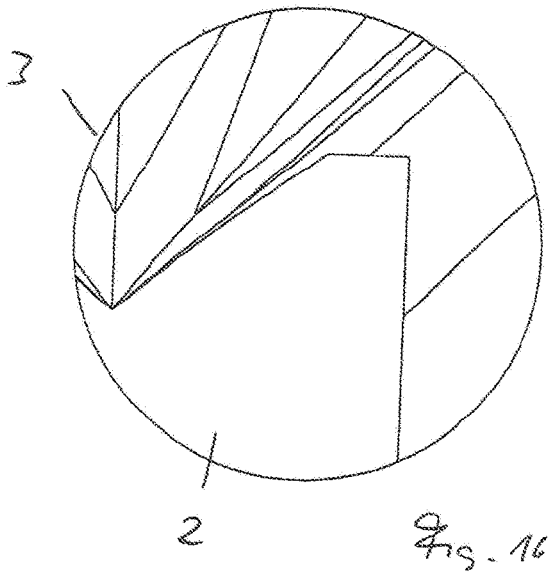
FIG. 16 shows an enlarged illustration of the detail XVI in FIG. 14.

The illustrations in FIG. 14 and FIG. 16 correspond substantially to the illustrations in FIG. 11 and FIG. 13.

Figure 15:
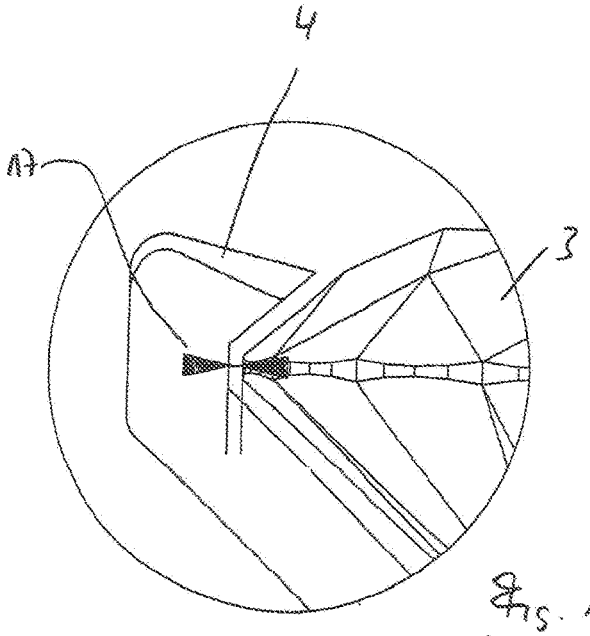
FIG. 15 shows an enlarged illustration of the detail XV in FIG. 14.

FIG. 15 illustrates a specific realization of the spacing (17) with a value of 0.05 mm.

Figure 17:
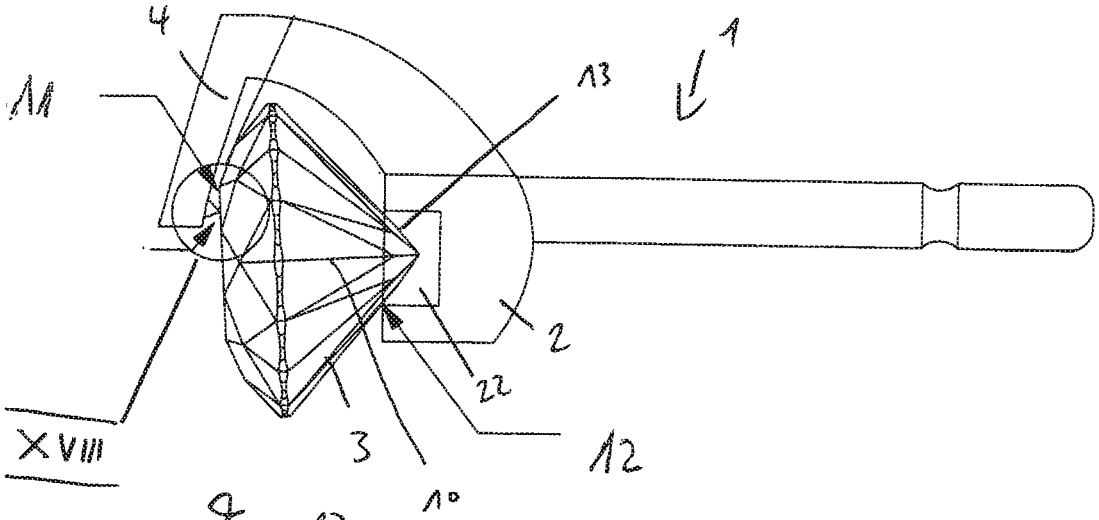
FIG. 17 shows a side view of a further embodiment in a configuration of the item of jewelry as an ear stud.

FIG. 17 shows a configuration of the item of jewelry (1) as an ear stud. According to this embodiment, it is in particular possible for the decorative element (3) to be oriented with its longitudinal axis (10) with a horizontal orientation component. Furthermore, a very open arrangement and mounting of the decorative element (3) is realized. In particular, it is possible for many regions of the decorative element (3) to also be freely apparent at the sides.

In the arrangement illustrated in FIG. 17, the first contact point (11) is provided by the retaining element (4) and the second contact point (12) by the base element (2). In particular, the idea is to arrange a protrusion (18) in the region of an inner boundary, facing the decorative element (3), of the retaining element (4), said protrusion (18) having for example a contour that tapers to a point (3) direction of the decorative element (3). This can be realized for example by a conical shape of the protrusion (18).

According to the embodiment in FIG. 17, an insert (22) is arranged in the region of the base element (2), said insert (22) providing the recess (13) for receiving and guiding the decorative element (3). In this embodiment, too, it would also be possible in principle for the recess (13) to be introduced directly into the material of the base element (2), however. It is also possible for an insert (22) to be used in all the other embodiments.

In an exemplary embodiment illustrated in FIG. 17, the decorative element (3) is largely freely visible, apart from that region that is received by the base element (2) or by the insert (22), and is covered only regionally by the retaining element (4). The decorative element (3) can carry out both tilting movements and lifting movements in the direction of the longitudinal axis (19) and also rotational movements about the longitudinal axis (10) within the range of movement provided by the boundary points (11, 12).

According to a further embodiment, it is possible for the decorative element (3) to be mounted, for example in a part of its extent that faces the base element (2), by an insert which is then received regionally by the recess (13). Such an insert could have for example a hollow conical shape.

Figure 18:
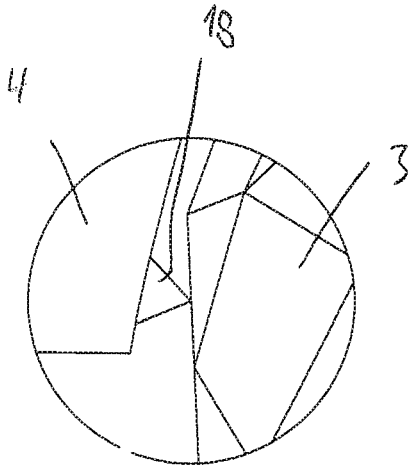
FIG. 18 shows an enlarged illustration of the detail XVIII in FIG. 17.

FIG. 18 shows an enlarged illustration of the detail (XVII) in FIG. 17 and illustrates in particular a structural realization of the protrusion (18).

Figure 19:
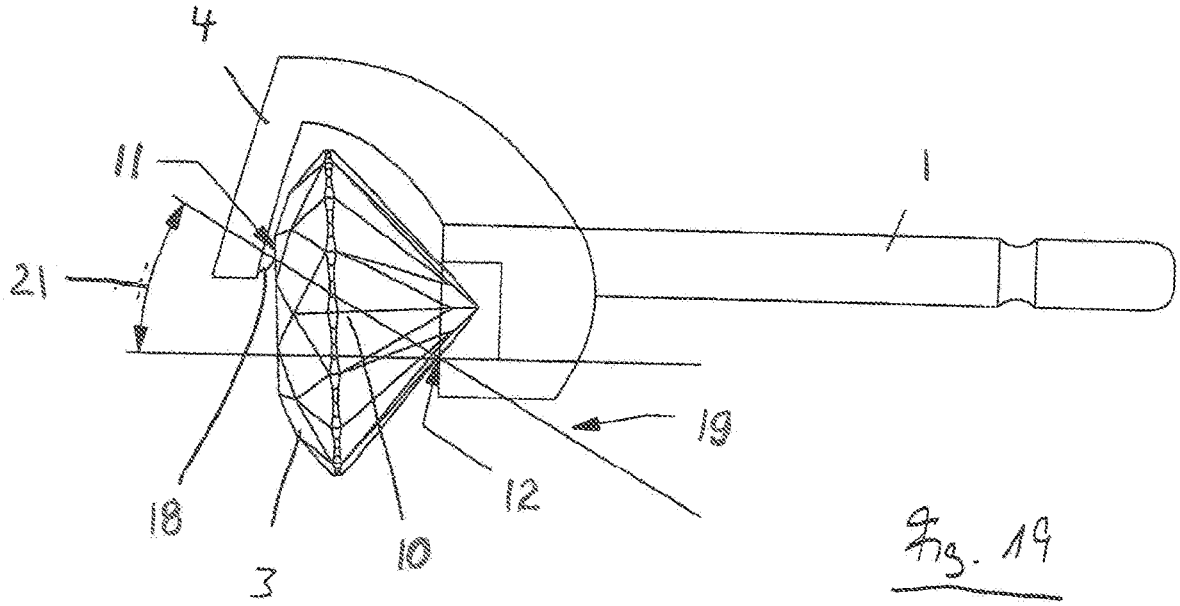
FIG. 19 shows a modified illustration of the ear stud in FIG. 17.

FIG. 19 shows the embodiment of the item of jewelry (1) as an ear stud according to FIG. 17 with ranges of movement and guiding regions additionally being illustrated.

In this embodiment, the protrusion (18) is realized with a rounded contour. An axis of rotation (19) extends at an angle (21) with respect to a horizontal direction (29). The angle (21) is about 30 degrees in the exemplary embodiment illustrated.

In a preferred design, the axis of rotation (19) extends in an orientation other than a horizontal direction.

It is likewise preferred for the contact point (11) to be located above the contact point (12).

In the case of a realization of the angle (21) in a range from 25 degrees to 35 degrees, an approximately periodic to-and-fro movement of the decorative element (3) can be achieved.

It is likewise preferred for the angle (21) to be at most 1 degree. More preferably, the angle (21) is at most 70 degrees.

Figure 20:
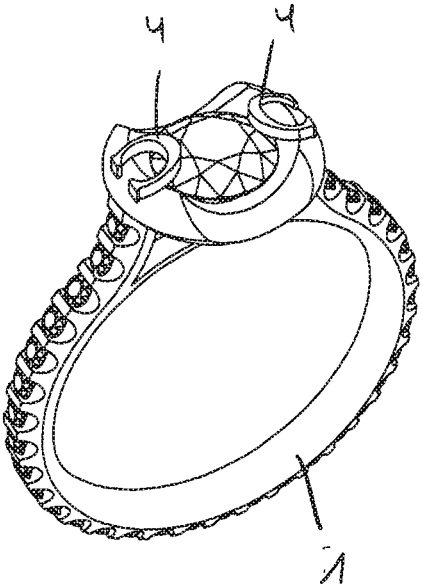
FIG. 20 shows a perspective illustration of a ring having a movable decorative element.

FIG. 20 shows an embodiment of the item of jewelry (1) as a ring. The retaining elements (4) are in this case in the form of a horseshoe, or of the letter "C".

Figure 21:
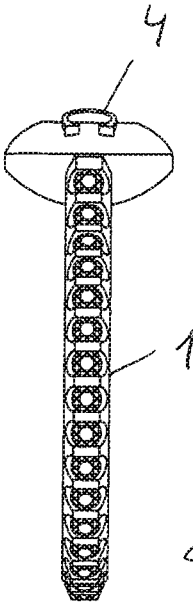
FIG. 21 shows a side view of the ring according to FIG. 20.
Figure 22:
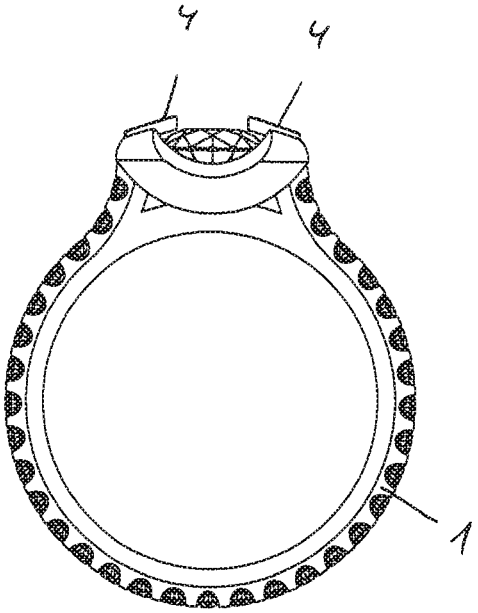
FIG. 22 shows a further side view of the ring according to FIG. 20.
Figure 23:
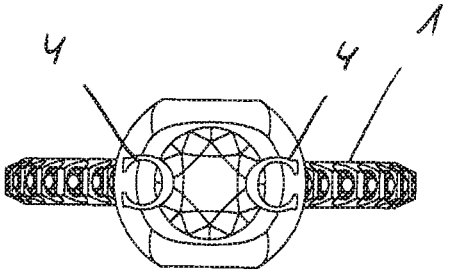
FIG. 23 shows a plan view of the ring according to FIG. 20.

FIG. 21 shows a side view and FIG. 22 a further side view of the ring according to FIG. 20. The specific realization of the retaining elements (4) can be seen again in the plan view in FIG. 23.

In principle, the retaining elements (4) can be realized with very different shapes. For example, it is also conceivable for the retaining elements (4) to be realized for example in the shape of a heart or star. The retaining elements (4) can be given their own decorative function as a result.

The invention claimed is:

1. An item of jewelry, comprising: a base element; at least one decorative element movable mounted in the base element such that the decorative element is movable relative to the base element, wherein the decorative element is arranged at least regionally in a recess in the base element; and at least one retaining element that secures the decorative element from dropping out of the recess, wherein the retaining element extends, starting from the base element in a direction from the base element to a middle of a top side of the decorative element, over only a part of the top side of the decorative element so that the middle of the top side of the decorative element is not hidden by the retaining element in a view direction perpendicular to the top side of the decorative element and only peripheral regions of the top side of the decorative element are covered by the retaining element in a view direction perpendicular to the top side of the decorative element, wherein the decorative element is a gemstone, wherein the top side of the decorative element has cut facets, wherein the recess has a conical center, wherein the retaining element is at a distance from a bottom of the recess so as to allow a lifting movement, a tilting movement and a rotational movement of the decorative element, wherein the decorative element is arranged in the base element so as to be visibly apparent at least regionally at the sides, wherein a lowermost point of the decorative element rests directly on a surface of the recess, wherein the at least one retaining element is hook-shaped and comprises a spacer bar that extends from the base element and transitions into a stop bar that projects over the decorative element, wherein the stop bar has a longitudinal axis oriented in a radial direction relative to a longitudinal axis of the base element.

2. The item of jewelry according to claim 1, wherein the longitudinal axis of the base element extends substantially in a vertical direction.

3. The item of jewelry according to claim 1, wherein the longitudinal axis of the base element extends substantially in a horizontal direction.

4. The item of jewelry according to claim 1, wherein the item of jewelry is an item of ear jewelry.

* * * * *